US007238906B2

(12) United States Patent
Michel

(10) Patent No.: US 7,238,906 B2
(45) Date of Patent: Jul. 3, 2007

(54) ELECTRICAL SWITCH OF THE NORMALLY CLOSED TYPE

(75) Inventor: Bruno Michel, Dole (FR)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 11/519,735

(22) Filed: Sep. 12, 2006

(65) Prior Publication Data

US 2007/0000767 A1 Jan. 4, 2007

Related U.S. Application Data

(63) Continuation-in-part of application No. PCT/EP2005/051407, filed on Mar. 29, 2005.

(30) Foreign Application Priority Data

Apr. 9, 2004 (FR) ..... 04 03780

(51) Int. Cl.
*H01H 13/14* (2006.01)
*H01H 3/12* (2006.01)

(52) U.S. Cl. ..... 200/341; 200/329; 200/520

(58) Field of Classification Search ..... 200/341–345, 200/520–521, 329, 276
See application file for complete search history.

(56) References Cited

U.S. PATENT DOCUMENTS

| | | | | |
|---|---|---|---|---|
| 5,082,997 | A * | 1/1992 | Vialy | 200/452 |
| 5,475,750 | A * | 12/1995 | McMonagle et al. | 379/355.01 |
| 6,064,019 | A * | 5/2000 | Buchan et al. | 200/302.2 |
| 6,242,706 | B1 * | 6/2001 | Miyata | 200/537 |
| 6,670,566 | B1 * | 12/2003 | Wang | 200/406 |
| 6,809,272 | B2 * | 10/2004 | Yamada | 200/1 B |

* cited by examiner

*Primary Examiner*—Richard K. Lee
(74) *Attorney, Agent, or Firm*—Peter Van Winkle

(57) ABSTRACT

The invention proposes a switch (10) comprising a casing (12) which carries a pair of fixed contact elements (48), a contact bar (96) which is movable between a rear closure position and a front opening position, and a member (60) for actuation of the movable contact bar (96) which is mounted so as to slide between a rear rest position and a front triggering position, the movable contact bar (96) and the actuation member (60) constituting a movable assembly, and the switch (10) comprising a return spring (108) which co-operates with the movable contact bar (96) so as to urge it towards its rear closure position.

7 Claims, 3 Drawing Sheets

ELECTRICAL SWITCH OF THE NORMALLY CLOSED TYPE

CROSS-REFERENCE TO RELATED APPLICATION

This is a Continuation-In-Part of PCT/EP2005/051407 filed 29 Mar. 2005, which designated the US, and which claimed priority from French patent application No. 04/03780 filed 9 Apr. 2004.

BACKGROUND OF THE INVENTION

The present invention relates to an electrical switch.

The invention relates more particularly to an electrical switch of the normally closed type comprising:

a casing which carries a pair of fixed contact elements each of which comprises a contact head which delimits a front transverse fixed contact surface and which is arranged inside the casing in such a way that the two fixed contact surfaces are longitudinally aligned:

a contact bar, forming a movable contact, which runs transversely opposite the two fixed contact surfaces and which is mounted movably, according to a horizontal longitudinal direction, between:

at least one rear closure position in which a rear contact surface of the contact bar is in contact bearing on the said fixed contact surfaces so as to establish an electrical link between the two fixed contact elements of the switch;

and a front opening position in which the said rear contact surface is offset longitudinally towards the front in such a way as to interrupt the said electrical link;

and a member for actuation of the movable contact bar which is mounted so as to slide longitudinally in the casing between:

at least one rear rest position in which it is in abutment against a portion of the casing and in which the movable contact bar is in its rear closure position;

and a front triggering position in which the movable contact bar is in its front opening position;

the moveable contact bar and the actuation member constituting a movable assembly, and the switch comprising a return spring which co-operates with the movable contact bar so as to urge it towards its rear closure position.

A switch of this type is known from document DE-A-3, 138,379.

In addition, it allows no modularity in the switch design, especially as regards the use of various light sources and/or the electrical connection and supply circuits for the light sources.

SUMMARY OF THE INVENTION

In order to afford it great stability of contact in the normally closed position, the switch according to the present invention is characterized in that the movable contact bar is mounted rocking on the actuation member about an upper transverse axis, the actuation member comprises a front face for driving the movable contact bar towards which the bar is returned by the spring, and the said front drive face is offset longitudinally towards the rear with respect to the contact bar when the bar is in its rear closure position and when the actuation member is in its rear rest position.

According to other characteristics of the invention:

the said front drive face is able to co-operate with a portion of the rear contact surface of the movable contact bar;

the said portion of the rear contact surface of the movable contact bar is situated between two transverse end portions each of which bears on an associated fixed contact surface when the bar is in its rear closure position;

the said rear contact surface is a surface in the form of an arc of a convex cylinder of transverse axis, and the said front fixed contact surfaces are vertical plane surfaces;

the actuation member comprises a horizontal central finger for guiding the return spring which runs towards the front through a corresponding notch of the movable contact bar, and the return spring is a spiral compression spring through which the guiding finger passes, the front longitudinal end of which bears on a wall of the casing, and the rear longitudinal end of which bears on a front face portion of the movable bar;

the actuation member is able to occupy a so-called overtravel position which is offset longitudinally towards the front with respect to its front triggering position;

the switch exhibits a general symmetry of design with respect to a vertical and longitudinal mid plane.

Other characteristics and advantages of the invention will become apparent on reading the detailed description of a preferred embodiment of the invention for the understanding of which reference may be made to the appended drawings.

DESCRIPTION OF THE PREFERRED EMBODIMENT

Figure 5:
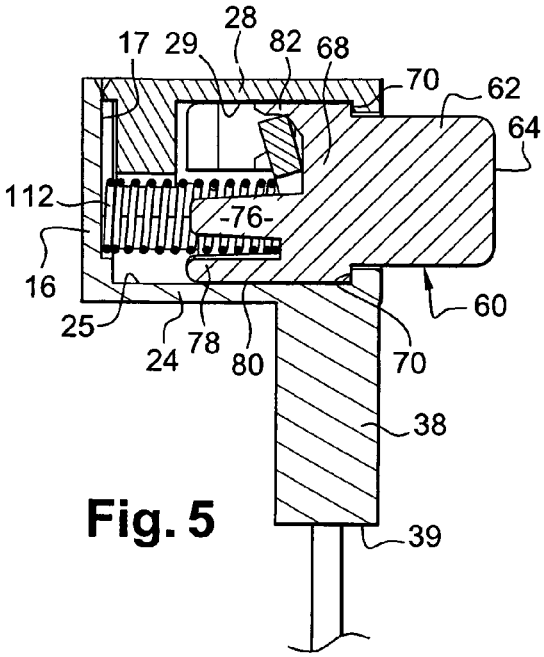
FIGS. 5 to 7 are sectional views along the lines 5—5 and 7—7 of FIG. 3 in which the member is illustrated in the rear rest position and the movable contact bar is illustrated in its rear closure position.

In the description which follows, in order to facilitate the comprehension thereof and of the claims, the terms horizontal, vertical, upper, lower, longitudinal and transverse will be adopted with reference to the trihedrons L, V, T indicated in the figures.

The front, rear orientation would also be used according to the left, right orientation of FIGS. 5 to 9.

The switch 10 illustrated in the figures is an electric switch of the normally closed type which exhibits a symmetry of design and embodiment with respect to a vertical mid plane of longitudinal orientation PVM.

It comprises a main body or casing 12 of right-angled parallelepipedal general shape delimited by two opposite vertical lateral walls 14, a front transverse vertical wall 16, a rear transverse vertical wall 18 which comprises a centred rectangular vertical window 20 which emerges into its free upper edge 22, and by a horizontal bottom wall 24.

Figure 1:
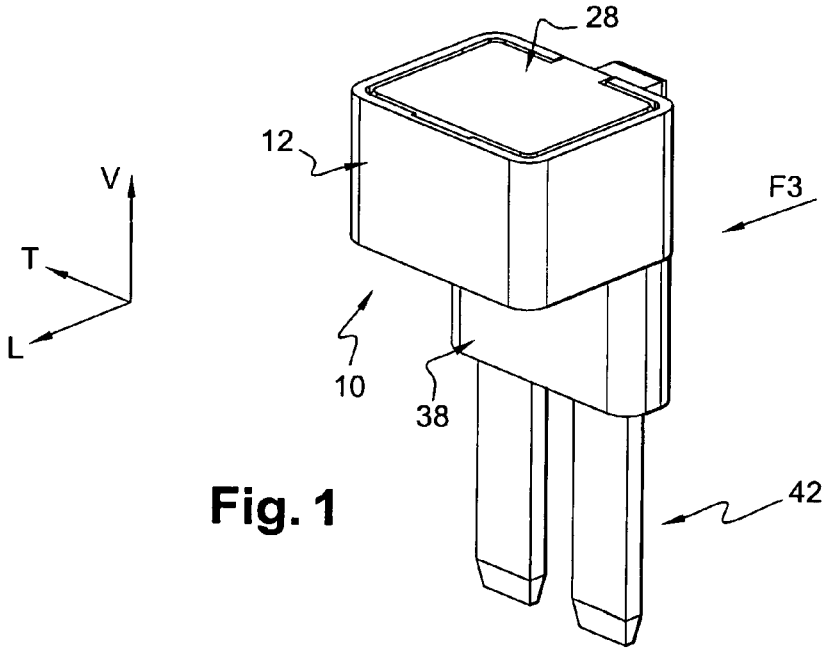
FIG. 1 is a front three-quarter perspective top view of a switch embodied in accordance with the teachings of the invention.
Figure 2:
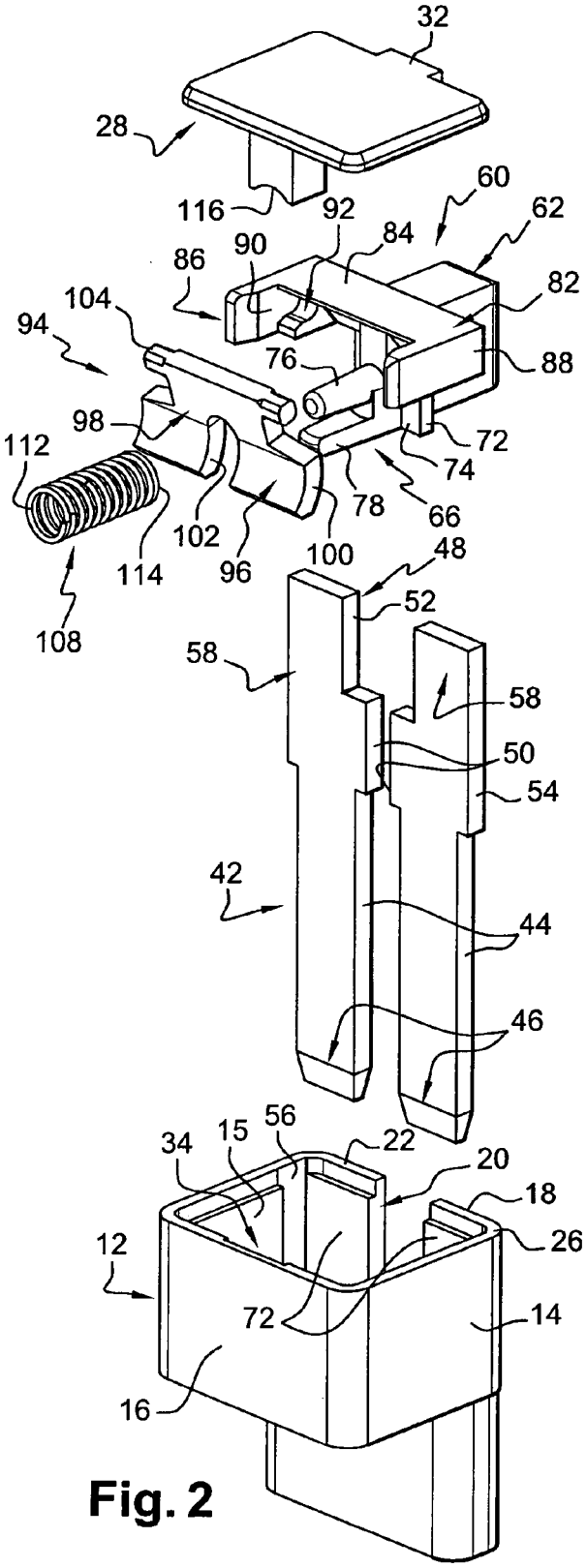
FIG. 2 is an exploded perspective view, similar to that of FIG. 1, which illustrates the various components of the switch.
Figure 3:
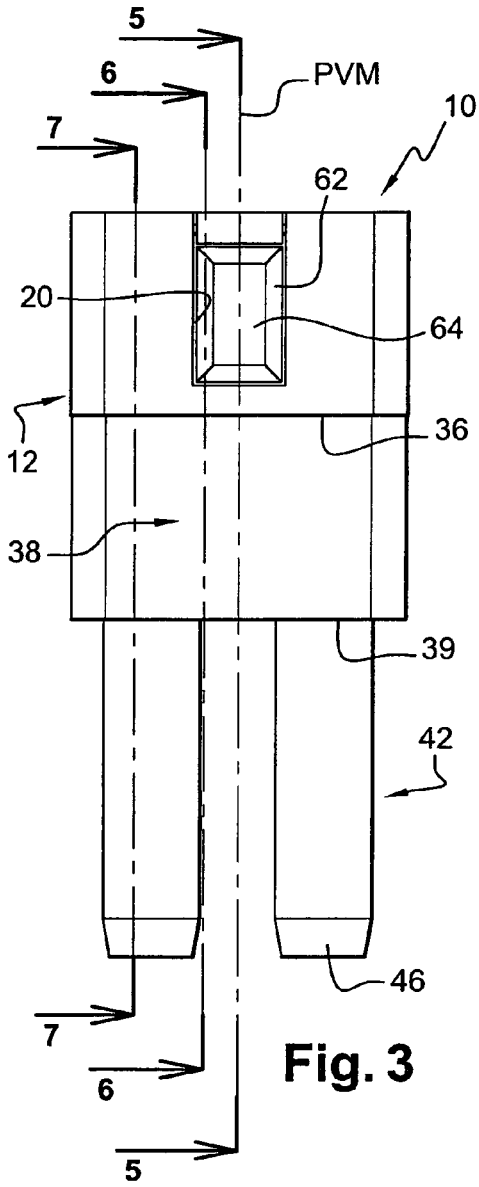
FIG. 3 is an end view along the arrow F3 of FIG. 1.
Figure 4:
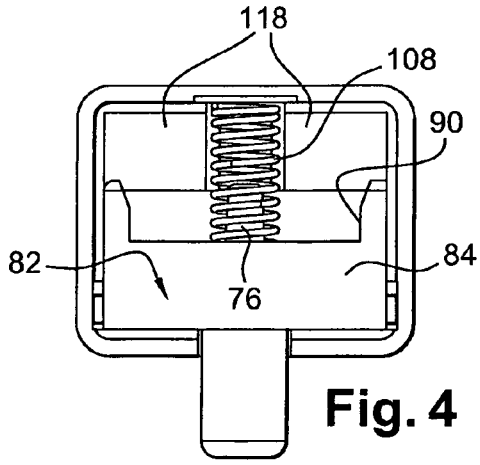
FIG. 4 is a plan view of the switch of FIG. 3, without its upper lid.

The open upper face 26 of the casing 12 is closed by complementary upper lid 28 in the form of a horizontal plate whose rear transverse edge 30 comprises a polarization lug 32 which, in the lid mounted position and as may be seen for example in FIG. 1, is received in the upper part of the window 20.

The walls 14, 16, 18, the bottom 24 and the upper lid 28 delimit an internal cavity 34 in which various components of the switch 10 are arranged.

The casing is embodied by moulding from insulating plastic and it extends, vertically to the rear, beyond the lower face 36 of the bottom 24, via a block 38 narrower in the longitudinal direction, and which comprises two emergent vertical slots 40.

The switch 10 comprises two fixed contact elements 42 made of an electrically conducting material each of which is embodied by blanking from a vertical plate of transverse orientation.

Each fixed contact element 42 comprises a lower rod 44 which is received through an associated slot 40 and which projects vertically downwards beyond the lower face 39 of the lower block 38 so as to constitute an electrical connection terminal of the switch, for example for connection with a printed circuit board, not represented.

Each fixed contact element 42 comprises an upper contact head 48 which is arranged inside the internal cavity 34 of the casing 12 and in which it is positioned with accuracy and immobilized in position.

Each contact head 48 comprises, in its transversely interior vertical edge 50, an aperture 52 corresponding to the window 20, while its transversely exterior vertical edge 54 is received in a groove 56 of the interior face 15 of the associated lateral wall 14.

The front face 58 of each contact head 48 constitutes a fixed contact surface and the two surfaces 58 are substantially co-planar and of transverse vertical orientation.

The switch 10 comprises an actuation member or actuator 60 which comprises a front body 66 arranged inside the internal cavity 34 and a rear operating pusher or button 62.

The pusher 62 is of rectangular cross section complementary to the window 20 through which it projects longitudinally towards the rear in such a way that at least its rear transverse face 64 is permanently situated outside the casing 12 so as to allow actuation by acting on said face, from the rear to the front in the direction indicated by the arrow F3.

The pusher 62 is embodied in one piece by moulding from an insulating plastic together with the front body 66.

The front body 66 comprises a sturdy rear central part 68 whose rear face 70 bears against opposite portions of the interior face of the rear wall 18 when the actuation member 60 is in its rear rest position illustrated in FIGS. 3 to 7.

This central part 68 comprises two opposite vertical and transverse wings 72 of smaller longitudinal thickness than the central part 68 and each of which comprises a front transverse face 74 of vertical orientation which constitutes a part of the front face of the actuator for driving the movable contact element of the switch which will be described hereinbelow.

Between the two wings 72, the central part comprises a central horizontal finger 76 which runs longitudinally towards the front and, underneath the finger 76, a longitudinal central lower branch 78 for guiding and positioning the front body 66 which slides on the upper face 25 of the bottom wall 24.

To supplement the guiding by longitudinal sliding of the body 66 in the cavity 34, the former comprises on the one hand an upper horizontal partition or roof 82 whose horizontal upper face 84 slides along the lower face 29 of the lid 28 and, on the other hand, two opposite upper lateral branches 86 which run horizontally towards the front and each of which comprises an exterior vertical lateral face 88 which slides along the internal face 15 of the corresponding lateral wall 14 of the casing 12.

Thus, the front body 66 is perfectly guided by longitudinal sliding in the internal cavity 34.

Finally, the front body comprises two housings 92 forming bearings of common horizontal and transverse axis A.

Each bearing 92 is arranged projecting along the internal vertical lateral face 90 of a lateral branch 86 and under the roof 82.

Each bearing 92 is semi-cylindrical and it is open longitudinally towards the front.

The movable contact element 94 of the switch 10 is embodied in the form of a rocker made of a conducting material which is embodied by blanking, forming and blowing from a thick plate.

The rocker 94 comprises a lower movable contact bar 96 and an upper articulation part 98 for its rockable mounting on the front body 66 of the actuator 60, about the axis A.

The lower movable contact bar 96 runs horizontally and transversely inside the cavity 34.

In cross section through a longitudinal vertical plane, it exhibits a globally bowed profile in the form of a cylindrical arc and it is thus delimited by a convex inwardly curved rear face which constitutes the rear contact surface 100 of the movable bar 96 which is able to co-operate with the fixed contact surfaces 58. The central part of the contact bar 96 comprises a notch 102 which is open towards the bottom for the passage of the horizontal central finger 76.

The upper articulation part 98 of the rocker 94 comprises two opposite co-axial lateral journals 104 each of which is received rotatably in a semi-cylindrical bearing 92.

The switch 10 finally comprises a spiral compression spring 108 through the rear part of which the finger 76 for guiding the spring passes longitudinally. The spring is mounted compressed longitudinally between the front concave bent face 97 of the contact bar 96 against which it bears via its rear end turn 114 and an opposing portion of the internal face 17 of the front transverse wall 16 against which it bears via its front end turn 112.

The guidance of the return spring 108 is moreover ensured by a lower stud 116 of the cover 28 and by two internal lateral studs 118 of the casing 12.

When the rocker 94 is mounted on the front body 66, it constitutes together with the latter an assembly that is longitudinally movable in the internal cavity 34.

For this purpose, the return spring 108 forces the journals 104 into the depths of the bearings 92 permanently.

Figure 6:
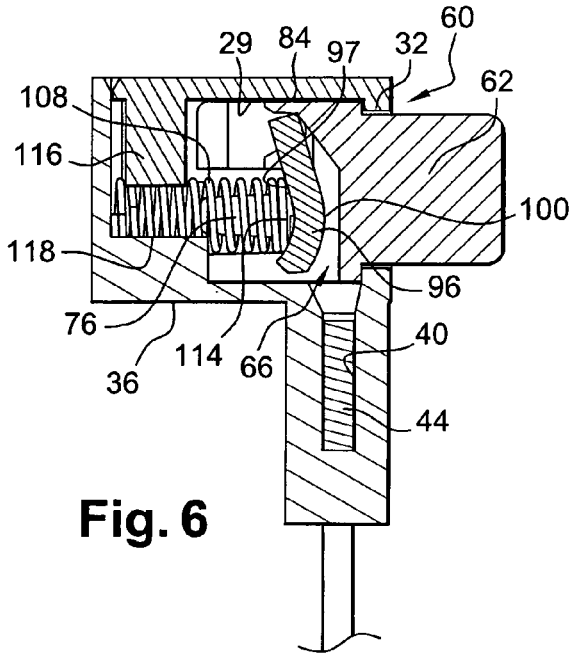
Figure 7:
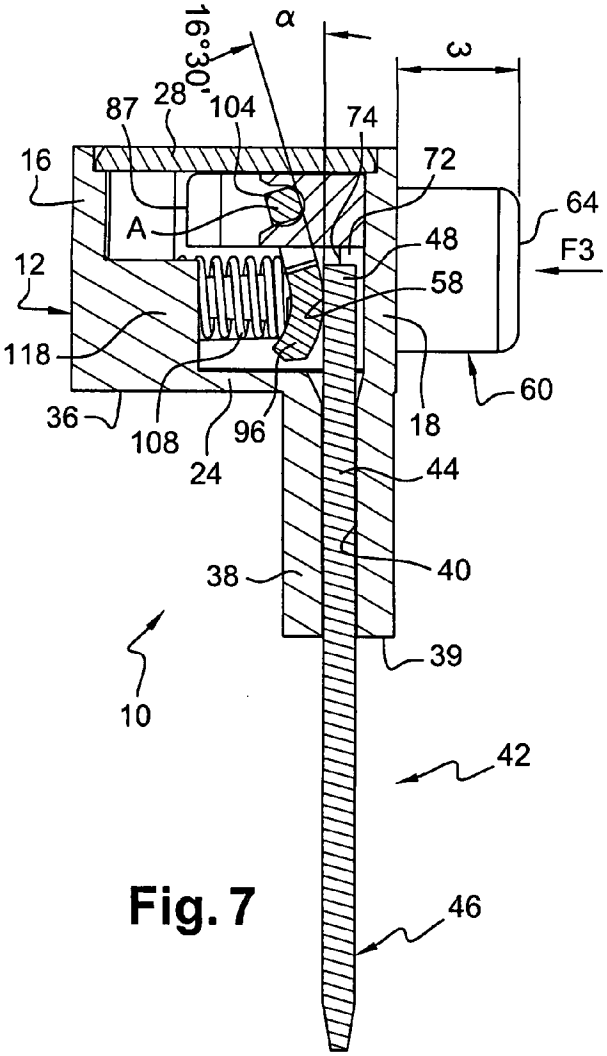

In the rear rest position, and as may be seen in FIGS. 5 to 7, the dimensions and the arrangement of the various components are such that the front faces 74 for driving the actuation member 60, 66 which are substantially co-planar, are situated longitudinally towards the rear set back from the front fixed contact faces 58.

Consequently, the rear face 100 bears longitudinally, via its opposite transverse end spans or portions, on the fixed contact faces 58 with a high contact pressure due to the action of the return spring 108.

In this position, the electrical link between the two fixed contact elements 42 is closed by the contact bar 96 and the switch 10 is thus of the so-called normally closed type NF at rest, that is to say when no action is exerted on the push button 62.

In this rest position of the actuator 60 and closure position (of the link) of the movable contact bar 96, the rocker 94 is in an angular position, about its axis A, in which the rear face 99 of its upper articulation part 98 forms an acute angle alpha with respect to the vertical which, in the example illustrated in FIG. 7, is around 16°30'.

From this position, by exerting an actuation force along the arrow F3 on the rear face 64 of the push button 62, the front body 66 moves longitudinally towards the front against the force exerted by the return spring 108.

Figure 8:
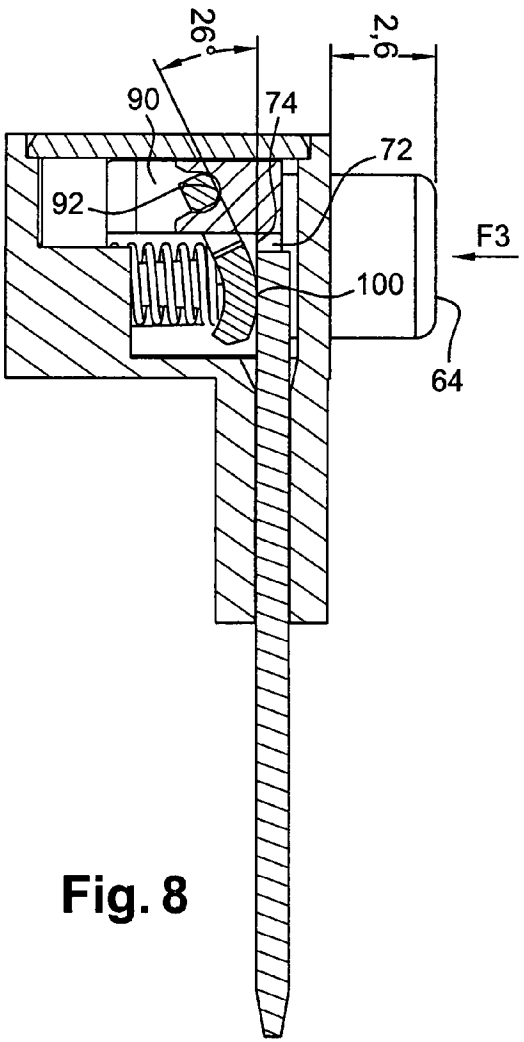
FIG. 8 is a view similar to that of FIG. 7 in which the member is illustrated in the front triggering position.

During this actuation travel, the journals remain supported in the bearings and the upper part 98 moves with the front body 66, while the rocker 94 rocks progressively in the anti-clockwise direction so as to reach the position illustrated in FIG. 8.

In this so-called triggering position of the switch 10, the front actuation faces 74 have reached the opposing portions of the convex rear face 100 of the movable contact bar 96 so that they are henceforth mutually supported.

On completion of this actuation travel, or triggering travel (very short of the order of 0.4 mm) the angle alpha is of the order of 26°. This angle is henceforth a maximum since the rocker 94 can no longer pivot further with respect to the front body 66.

Between the rear rest position and the position of triggering of the switch, the movable contact 94 rubs on the two contact heads 48 during the rocking thereof. This rubbing of the moveable contact 94 ensures self-cleaning of the contact surfaces.

Once the forward travel continues, the rear transverse contact face 100 of the movable contact bar 96 leaves the front fixed contact surfaces 58 of the heads 48, interrupting the electrical link between the contact elements 42. The bar thus occupies its front position, so-called opening position (of the electrical link).

Figure 9:
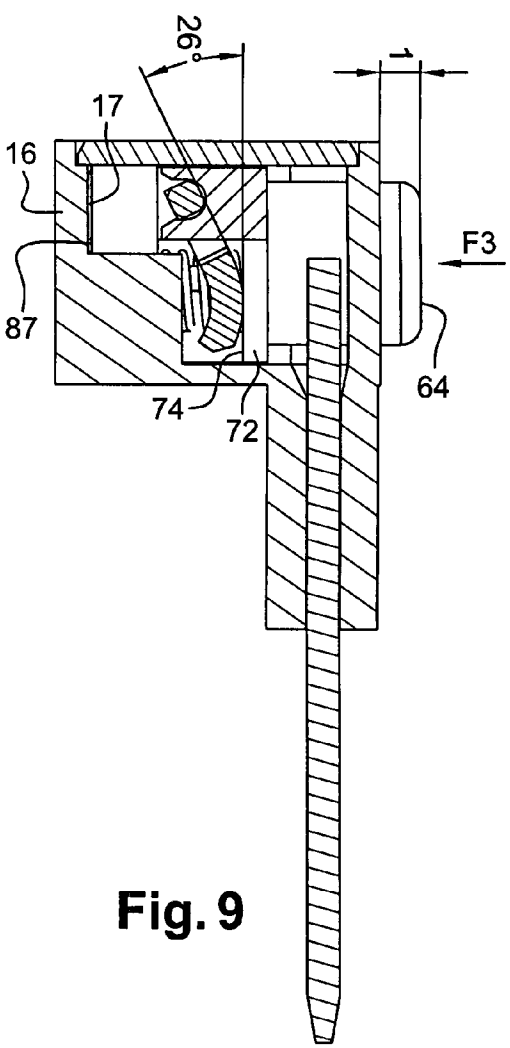
FIG. 9 is a view similar to that of FIG. 7 in which the member is illustrated in its overtravel position.

As may be seen by comparing FIGS. 8 and 9, it is possible to apply to the push button 62, and hence to the actuation member 60, an overtravel of actuation according to the arrow F3 which here is a maximum of 1.6 mm, i.e. a maximum total travel of the button of the order of 2 mm. This position is determined in particular by the coming into abutment of the front free ends 87 of the upper lateral branches 86 against the opposing portions of the internal face 17 of the front transverse wall 16.

When the user relaxes his action on the push button 62, and under the action of the return spring 108 which acts permanently on the contact bar 96 and hence on the front body 66 of the actuator 60, the movable assembly 60–94 recoils rearwards, passing again through the position illustrated in FIG. 8 in which the electrical link is again established by the coming into contact of the movable contact bar 96–100 with the front fixed contact surfaces 58.

Thereafter, the bar 96 no longer moves longitudinally towards the rear and it is the rocker 94 which rocks in the clockwise direction to compensate for the end of travel of the actuator 60–66 until its rear rest position illustrated in FIG. 7.

By virtue of the design according to the invention, one ensures very good contact pressure of the movable contact bar 96 on the fixed contacts 48–58 and very good stability of the contact until the opening of the electrical link.

What is claimed is:

1. An electric switch (10) of the normally closed type comprising:

a casing (12) which carries a pair of fixed contact elements (42) each of which comprises a contact head (48) which delimits a front transverse fixed contact surface (58) and which is arranged inside (34) the casing (12) in such a way that the two fixed contact surfaces (58) are longitudinally aligned;

a contact bar (96), forming a movable contact, which runs transversely opposite the two fixed contact surfaces (58) and which is mounted movably, according to a horizontal longitudinal direction, between;

at least one rear closure position in which a rear contact surface (100) of the contact bar (96) is in contact bearing on the said fixed contact surfaces (58) so as to establish an electrical link between the two fixed contact elements (42) of the switch (10);

and a front opening position in which the said rear contact surface (100) is offset longitudinally towards the front in such a way as to interrupt the said electrical link;

and a member (60) for actuation of the movable contact bar (96) which is mounted so as to slide longitudinally in the casing (12) between;

at least one rear rest position in which it is in abutment against a portion (70) of the casing (12) and in which the movable contact bar (96) is in its rear closure position;

and a front triggering position in which the movable contact bar (96) is in its front opening position;

the moveable contact bar (96) and the actuation member (60) constituting a movable assembly, and the switch (10) comprising a return spring (108) which co-operates with the movable contact bar (96) so as to urge it towards its rear closure position;

characterized in that the movable contact bar (96) is mounted rocking on the actuation member (60, 66, 92) about an upper transverse axis (A), in that the actuation member (60, 72) comprises a front face (74) for driving the movable contact bar (96) towards which the bar is returned by the spring (108), and in that the said front drive face (74) is offset longitudinally towards the rear with respect to the contact bar (96) when the bar is in its rear closure position and when the actuation member (60) is in its rear rest position.

2. Switch according to claim 1, characterized in that the said front drive face (74) is able to co-operate with a portion of the rear contact surface (100) of the movable contact bar (96).

3. Switch according to claim 2, characterized in that the said portion of the rear contact surface (100) of the movable contact bar (96) is situated between two transverse end portions each of which bears on an associated fixed contact surface (58) when the bar (96) is in its rear closure position.

4. Switch according to claim 1, characterized in that the said rear contact surface (100) is a surface in the form of an arc of a convex cylinder of transverse axis, and in that the said front fixed contact surfaces (58) are vertical plane surfaces.

5. Switch according to claim 1, characterized in that the actuation member (60) comprises a horizontal central finger (76) for guiding the return spring (108) which runs towards the front through a corresponding notch (102) of the movable contact bar (96), and in that the return spring (108) is a spiral compression spring through which the guiding finger passes, the front longitudinal end (112) of which bears on a wall (16, 17) of the casing, and the rear longitudinal end (114) of which bears on a front face portion (96) of the movable bar.

6. Switch according to claim 1, characterized in that the actuation member (60) is able to occupy a so-called overtravel position which is offset longitudinally towards the front with respect to its front triggering position.

7. Switch according to claim 1, characterized in that it exhibits a general symmetry of design with respect to a vertical and longitudinal mid plane (PVM).

* * * * *